US008319153B2

(12) United States Patent
Burrows et al.

(10) Patent No.: US 8,319,153 B2
(45) Date of Patent: Nov. 27, 2012

(54) GLOW PLUG WITH METALLIC HEATER PROBE

(75) Inventors: John A Burrows, Northwich (GB); Marcello Cino, Rubiera (IT); Sandro Goretti, Rubiera (IT)

(73) Assignee: Federal-Mogul Italy Srl., Modena (IT)

( * ) Notice: Subject to any disclaimer, the term of this patent is extended or adjusted under 35 U.S.C. 154(b) by 1037 days.

(21) Appl. No.: 12/271,948

(22) Filed: Nov. 17, 2008

(65) Prior Publication Data

US 2010/0122975 A1 May 20, 2010

(51) Int. Cl.
*F23Q 7/22* (2006.01)
*F23Q 7/00* (2006.01)

(52) U.S. Cl. ..... 219/267; 219/260

(58) Field of Classification Search ..... 219/260–270; 123/143 R–143 C
See application file for complete search history.

(56) References Cited

U.S. PATENT DOCUMENTS

| | | | |
|---|---|---|---|
| 2,144,891 | A | 1/1939 | Nittka |
| 4,426,568 | A | 1/1984 | Kato et al. |
| 4,563,568 | A | 1/1986 | Takizawa |
| 4,577,601 | A | 3/1986 | Klak |
| 4,636,614 | A | 1/1987 | Itoh et al. |
| 4,661,686 | A | 4/1987 | Yokoi et al. |
| 4,963,717 | A | 10/1990 | Woelfle |
| 5,039,839 | A | 8/1991 | Masaka et al. |
| 5,132,516 | A | 7/1992 | Hatanaka et al. |
| 5,206,483 | A | 4/1993 | Aota |
| 6,660,971 | B2 | 12/2003 | Terada et al. |
| 7,041,938 | B2 | 5/2006 | Kumada et al. |
| 7,223,942 | B2 | 5/2007 | Konishi et al. |
| 2005/0284859 | A1 | 12/2005 | Konishi |
| 2005/0284860 | A1 | 12/2005 | Yoshikawa et al. |
| 2007/0290596 | A1 | 12/2007 | Lykowski |

FOREIGN PATENT DOCUMENTS

| | | | |
|---|---|---|---|
| JP | 06241451 | A | 8/1994 |
| JP | EP 1136697 | A2 | 9/2001 |
| JP | EP 1455086 | A1 | 9/2004 |

*Primary Examiner* — Daniel L Robinson
(74) *Attorney, Agent, or Firm* — Robert L. Stearns; Dickinson Wright, PLLC

(57) ABSTRACT

A glow plug assembly (110) has a metallic heater probe (118) supported within a metal shell (112). A transition zone (144) at the base of the shell (112) includes a membrane (146) and a tube portion (148). A first open end (130) of the heater probe (118) is formed with a reduced diameter pilot section (150) that mates with the tube portion (148) to establish a joint area between the components. The membrane (146) may be made elastically deflectable so as to accommodate integration of a pressure sensor (156) in the glow plug assembly (110).

19 Claims, 7 Drawing Sheets

GLOW PLUG WITH METALLIC HEATER PROBE

CROSS REFERENCE TO RELATED APPLICATIONS

None.

BACKGROUND OF THE INVENTION

1. Field of the Invention

This invention relates generally to glow plugs of the type for assisting cold start combustion in a combustion chamber, and more particularly toward a glow plug having a metallic heater probe.

2. Related Art

Glow plugs are typically used in applications where a source of intense heat is required to either directly initiate or to aid in the initiation of combustion. As such, glow plugs are used in space heaters, industrial furnaces and diesel engines to name a few. Glow plugs used in diesel engine applications are usually categorized as either open coil type or sheathed type devices. Sheath type glow plugs are then divided between ceramic type heater probes and metallic type heater probes. In a metallic type sheath heater probe, one or more spiral wound resistive wires are contained within a metallic sheath, embedded in an electrically insulating and thermally conductive powder. A glow plug of this type is described, for example, in U.S. Pat. No. 4,963,717. The electrical resistance wire(s) located in the sheath are totally embedded in the insulating powder and the insulating powder is sealed in the sheath using an elastomeric o-ring seal or other gasketing device.

Metallic type sheathed heater probes are normally inserted into the glow plug shell by mechanical interference fit. An interference fit requires a high strength from both the probe and the shell, together with accurate manufacturing tolerances. The requirement for high strength limits the minimum metal thicknesses which can be used in these applications, leading to a minimum possible diameter at the shell-tube-probe joint. This requirement similarly leads to a minimum possible diameter for the probe, which is currently around 4 millimeters. Thus, the joint surface (probe-to-shell) must have at least this diameter using present techniques.

Management of a diesel engine may be improved if combustion chamber pressures are monitored in real time. Pressure sensors can be introduced as stand-alone devices, or more preferably as integrated into a glow plug. One design of integrated glow plug pressure sensor uses a flexible membrane provided between the heater probe and shell. This increases the glow plug dimensions and further deters miniaturization of the various glow plug components. According to current techniques, the use of a metallic probe currently limits the minimum diameter of glow plug designs of this type, because there is not enough space for the membrane and the membrane is not strong enough to support an interference fit with the probe. Therefore, using current techniques, ceramic probes are typically used in this type of integrated pressure sensor applications to achieve a small glow plug diameter. When ceramic probes are used, the diameters can be reduced to about 3.2 millimeters using current technology, which diameter reduction allows the entire glow plug diameter to be similarly reduced. However, because ceramic probes are more expensive than metallic heater probes, an increase in glow plug cost results.

Accordingly, there is a desire to use small diameter metallic heater probes in glow plug applications so as to attain a large cost saving.

SUMMARY OF THE INVENTION

This invention provides a glow plug assembly of the type for assisting cold start combustion in a combustion chamber. The assembly comprises a generally tubular metal shell defining an axial bore, and a transition zone associated with the shell. The transition zone has a circular seat concentric with the bore and adapted to establish a seal against an opening in the combustion chamber. The transition zone further includes a generally annular membrane extending radially inwardly from the seat, and a hollow tube portion extending axially from the membrane. An elongated heater probe is axially aligned with the bore of the shell and includes a generally tubular metallic sheath extending between open first and closed second ends. The sheath has a generally cylindrical outer body surface. The sheath includes a reduced diameter pilot section adjacent its open first end. The pilot section has a reduced diameter relative to the outer body surface and is separated from the outer body surface by a shoulder. The reduced diameter pilot section and the shoulder form a joint area in direct abutting contact with the tube portion of the transition zone.

The subject invention describes a novel construction for a metallic heater probe which allows the joint face, i.e., the joint between glow plug shell and heater probe, to have a smaller diameter than the body of the heater probe. High stresses on this joint face can be avoided during assembly through a fixation technique which does not result in compressing the heater probe. Thus, the members to be joined can use thinner wall sections than heretofore known from prior art designs.

In another embodiment of this invention, a glow plug assembly of the type described includes an integrated pressure sensor for monitoring pressure fluctuations in an associated combustion chamber. Use of the novel joint construction enables a metallic heater probe to be fitted into a glow plug which, according to prior art techniques, would not otherwise be accommodated.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENT

Figure 1:
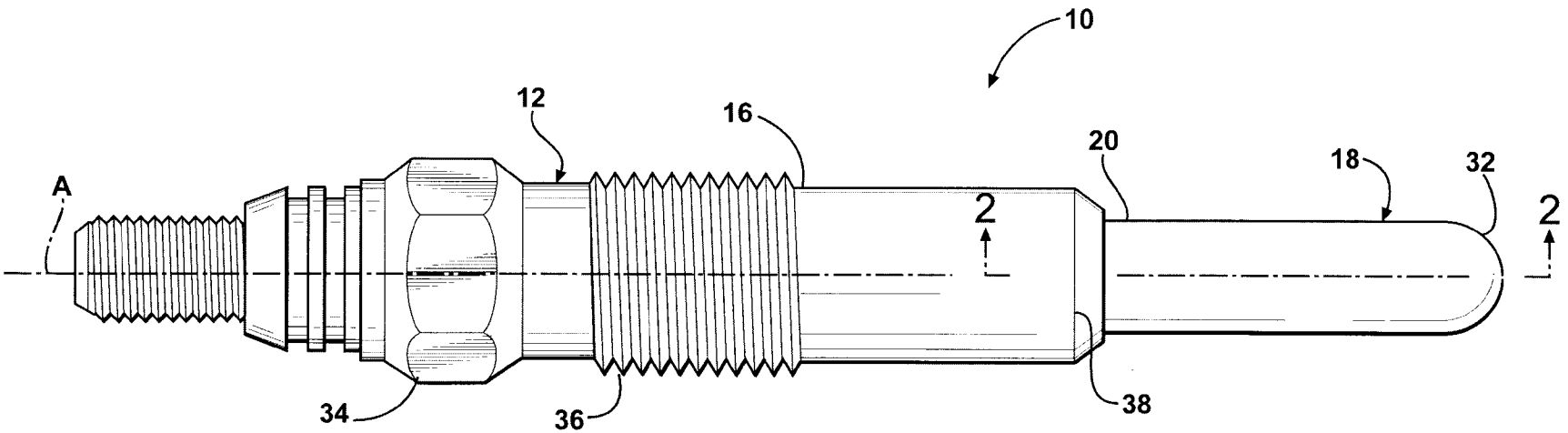
FIG. 1 Prior Art
FIG. 1 is a side elevation view of a prior art glow plug assembly of the type including a sheathed metallic heater probe.
Figure 2:
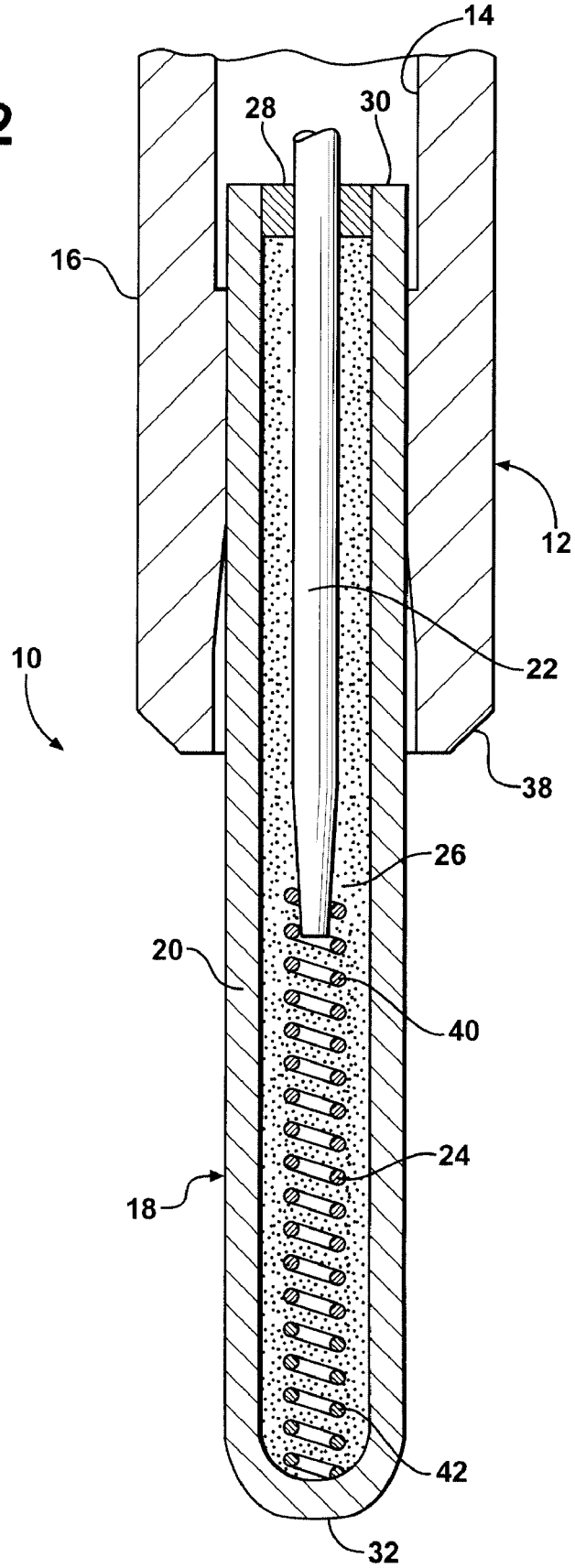
FIG. 2 Prior Art
FIG. 2 is a fragmentary cross-sectional view of the prior art heater probe assembly as taken generally along lines 2-2 in FIG. 1.

Referring to the Figures, wherein like numerals indicate like or corresponding parts throughout the several views, a glow plug according to the prior art is generally shown at 10 in FIGS. 1 and 2. The glow plug 10 includes an annular metal shell 12 having a bore 14 which extends along an imaginary longitudinal axis A. The shell 12 may be formed from any suitable metal, such as various grades of steel. The shell 12 may also incorporate a plating or coating layer, such as a nickel or nickel alloy coating over some or all of its surfaces including the exterior surface 16 and within the bore 14 so as to improve its resistance to high temperature oxidation and corrosion.

The glow plug assembly 10 includes a heater probe, generally indicated at 18. The heater probe 18 includes a metallic sheath 20, electrode 22, resistance heating element 24, powder packing material 26, and a seal 28. The sheath 20 is an electrically and thermally conductive member of generally tubular construction. Any suitable metal may be used to form the sheath 20, but metals having a resistance to high temperature oxidation and corrosion are preferred, particularly with respect to combustion gases and reactant species associated with the operation of an internal combustion engine. An example of a suitable metal alloy is a nickel-chrome-iron-aluminum alloy. The sheath 20 has a first open end 30 disposed within the bore 14 and in electrical contact with the shell 12. A second closed end 32 of the sheath 20 projects away from the bore 14.

The sheath 20 may have a deformed microstructure, such as a cold-worked microstructure where a sheath preform (not shown) is reshaped by swaging or otherwise to effect an overall reduction in diameter thereby increasing the density of the powder packing material 26 contained therein.

The shell 12 includes external wrenching flats 34 or other suitably configured tool-receiving portion to advance screw threads 36 into an appropriately tapped hole (not shown) in an engine cylinder head, pre-ignition chamber, intake manifold or the like. A tapered seat 38 bears against a complimentary-shaped pocket in the mating feature to perfect a pressure-tight seal in operation.

In FIG. 2, a fragmentary portion of the electrode 22 is depicted, showing an embedded section that extends into the first open end 30 of the sheath 20. The electrode 22 may be made from any suitable electrically conductive material, but is preferably a metal or even more preferably made from steel. Examples of suitable grades of steel include AISI 1040, AISI 300/400 family, EN 10277-3 family, Kovar*UNS K94610 and ASTM F15, 29-17 alloy. The resistance heating element 24 may be any suitable resistance heating device, including a wound or spiral wound resistance heating element. The resistance heating element 24 may have any suitable resistance characteristics so long as it is operable to provide the necessary time/temperature heating response characteristics needed for a specified application of the glow plug 10. This may include an element comprising a single (i.e., homogenous) electrical resistance element with a positive temperature coefficient characteristic (PTC characteristic), or a dual construction in which two series-connected electrical resistance elements are joined end-to-end. In this latter scenario, a first resistance element 40 is connected directly to the electrode 22 and fabricated from a material having a higher PTC characteristic than a second resistance element 42 which is connected to the second closed end 32 of the sheath 20. Thus, the first resistance element 40 acts as a current limiter or regulator element, while the second resistance element 42 acts as the heating element. Spiral wire resistance heating elements may be formed from any suitable material, including various metals such as pure nickel, various nickel, nickel-iron-chromium and iron-cobalt alloys to name but a few. Thus, in the example shown here in FIG. 2, a spiral wire, dual resistance heating element 24 is disposed in the sheath 20 with a proximal end thereof electrically connected and mechanically fixed by a metallurgical bond or weld to the electrode 22. A distal end of the resistance heating element 24 is electrically connected and mechanically fixed by a metallurgical bond to the second closed end 32 of the sheath 20. This mechanical attachment and metallurgical bond is formed when the distal end of the resistance heating element 24 is welded to the distal end of the sheath 20. This welding operation may be used to simultaneously form the closed end 32 of the tubular sheath 20 by sealing an opening in the distal end of an open ended preform.

Figure 3:
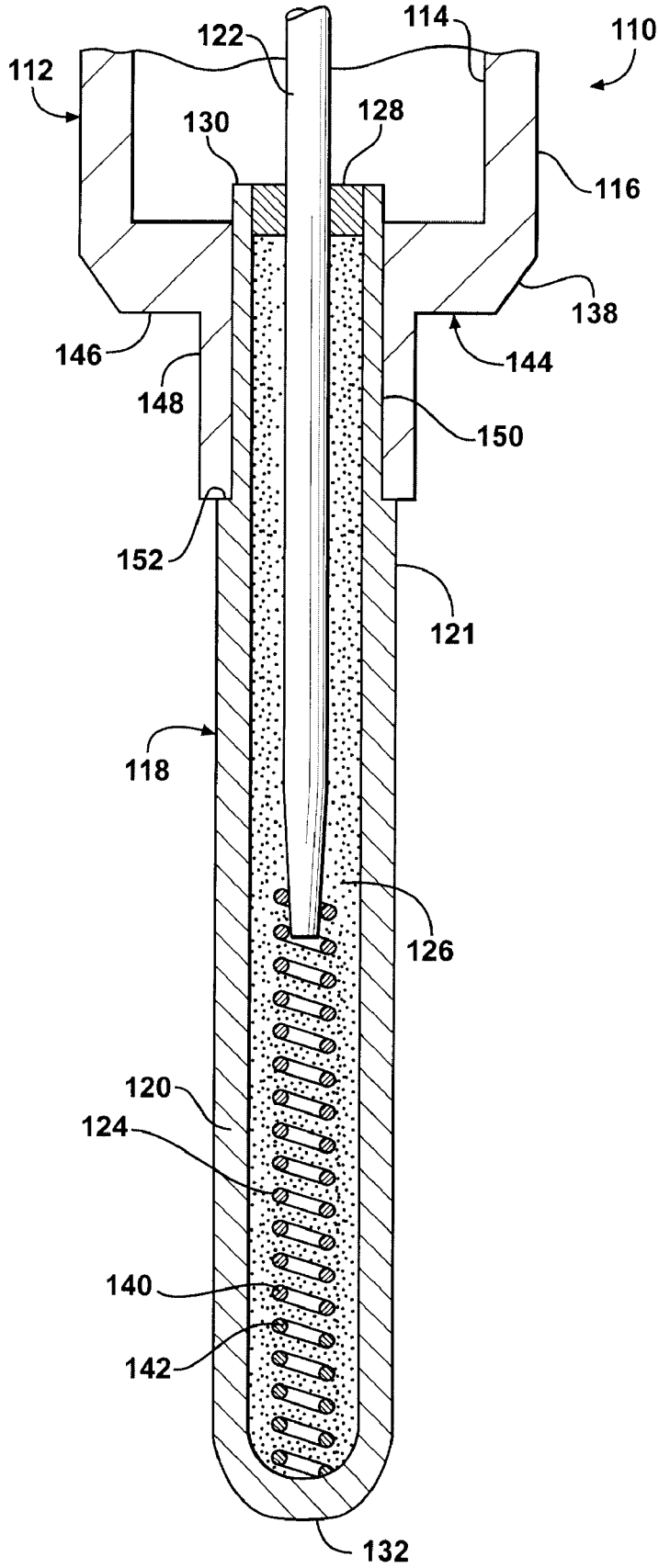
FIG. 3 is a cross-sectional view as in FIG. 2 but depicting a glow plug assembly constructed according to the principles of this invention.

Referring now to FIG. 3, an improved glow plug assembly according to the subject invention is depicted, wherein reference numerals previously set forth are offset by one hundred for continuity and convenience. A transition zone, generally indicated at 144, is associated with the shell 112. The transition zone 144 includes the circular seat 138, together with a generally annular membrane 146 extending radially inwardly from the seat 138. In this version of the invention, the membrane 146 is a thickened, integral continuation of the shell 112, and establishes a generally rigid inwardly projecting feature. The transition zone 144 further includes a hollow tube portion 148 extending axially from the membrane 146. The transition zone 144 serves to support and securely retain a small diameter metallic heater probe 118.

The heater probe 118 is reconfigured, as compared with prior art metallic probe designs, so as to join with the transition zone 144. Toward this end, the metallic sheath 120 includes a reduced diameter pilot section 150 at or adjacent its open first end 130. The pilot section 150 has a reduced diameter relative to the outer body surface 121 of the sheath 120, and is separated from the outer body surface 121 by a shoulder 152. The reduced diameter pilot section 150 and the shoulder 152 form a joint area in direct abutting contact with the tube portion 148 of the transition zone 144.

Figure 4:
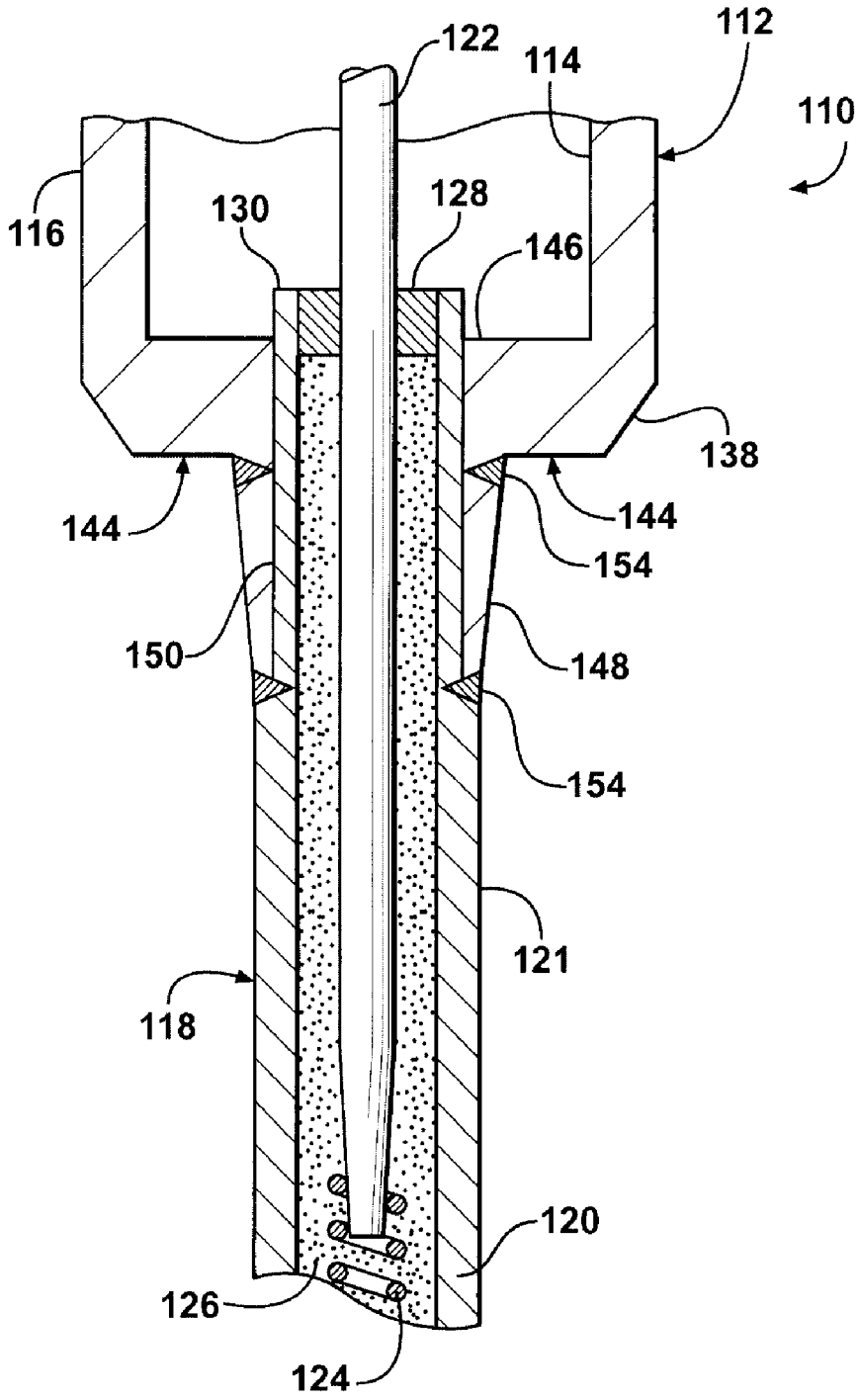
FIG. 4 is a fragmentary cross-sectional view of an alternative embodiment of this invention wherein the tube portion of the transition zone has a variable outer diameter along its length.
Figure 5:
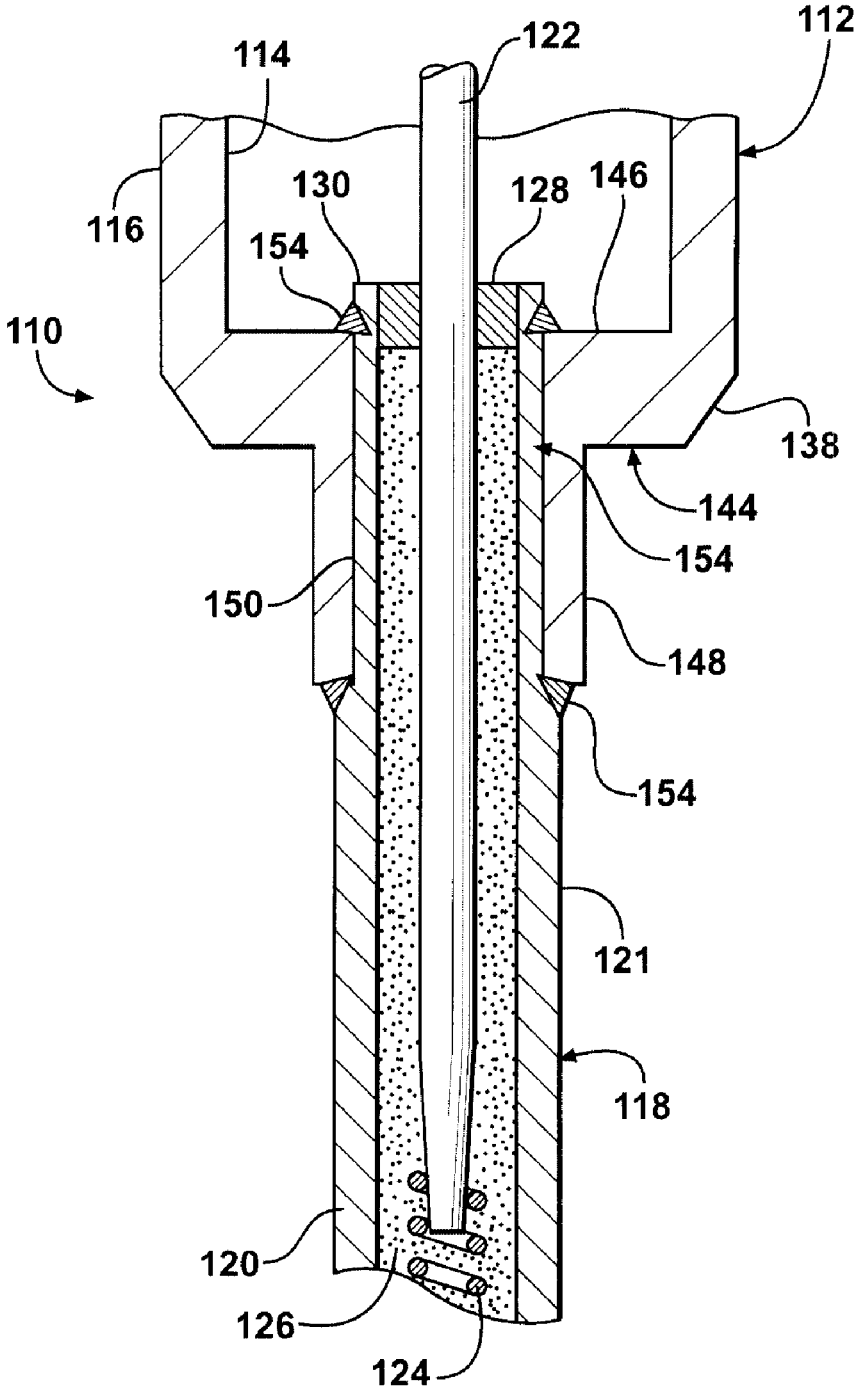
FIG. 5 is a view as in FIG. 4 but depicting yet another alternative embodiment wherein the outer diameter of the tube portion is greater than the diameter of the heater probe and a laser weld is applied near the sealing gasket.

The tube portion 148 has a generally constant outer diameter along its length. In this embodiment of the invention, the outer diameter of the tube portion 148 is greater than the diameter of the outer body surface 121 of the heater probe 118. The tube portion 148 can be affixed to the pilot section 150 using various techniques, including soldering or brazing. Alternatively, fixation of the tube portion 148 to the pilot section 150 can be accomplished with at least one weld 154. More preferably, at least two axially spaced welds 154 are used, as illustrated in FIGS. 4 and 5. In both of these examples, at least one of the welds, 154 passes through the shoulder 152. Welds 154 can be accomplished using laser welding techniques, or TIG welds, for example. Alternatively, under the right circumstances, the tube portion 148 can be affixed to the pilot section 150 with a mechanical interference fit.

Figure 6:
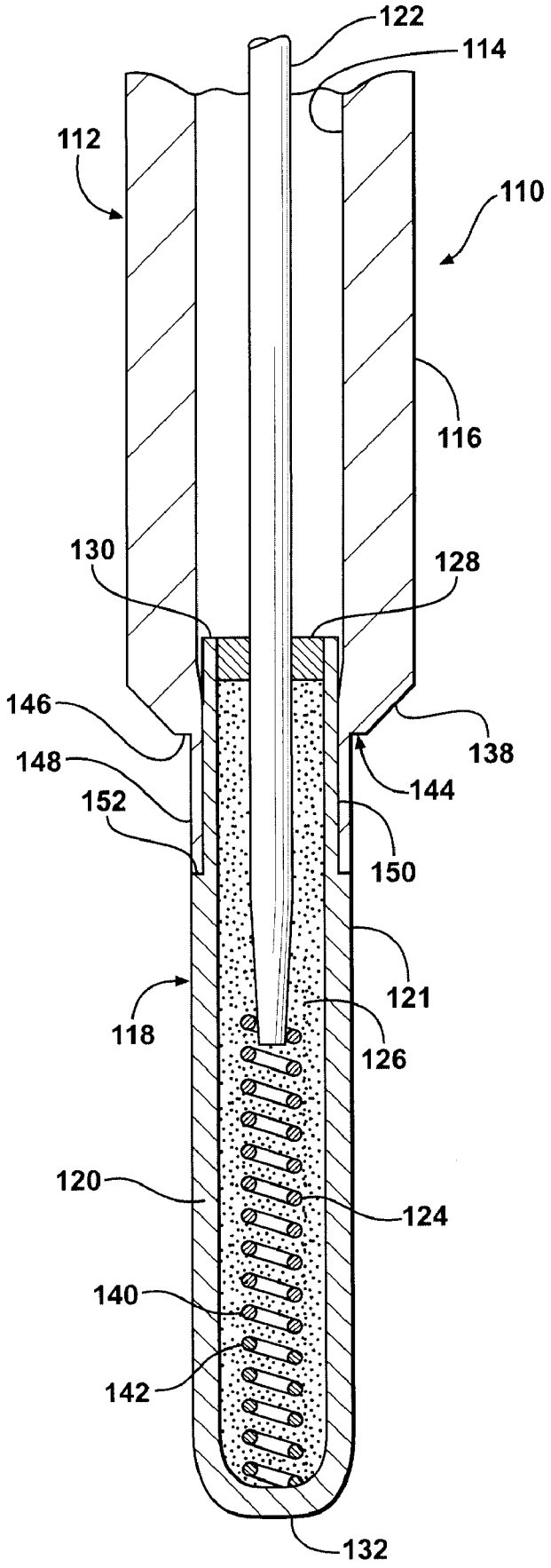
FIG. 6 is a cross-sectional view of the subject invention as in FIG. 3, but depicting yet another alternative embodiment of this invention wherein a pressure sensor is affixed between the electrode and the shell for monitoring pressure fluctuations in a combustion chamber.

In the alternative embodiment of FIG. 4, the tube portion 148 is configured so as to have a variable outer diameter along its length. In this case, a straight taper is established from a minimum outer diameter adjacent the shoulder 152 to a maximum outer diameter adjacent the membrane 146. In the alternative embodiment of FIG. 6, the outer diameter of the tube portion 148 is generally equal to the diameter of the outer body surface 121 of the heater probe 118. In the alternative embodiment of FIG. 6, the illustrated design could be used to make a glow plug 110 with very small diameter shell 112. This design would allow a very small diameter shell 112 to incorporate a heater probe 118 which would normally be too large. This could have applications in situations where it is difficult or expensive to make the diameter of the metallic probe 118 smaller, and the cost of a ceramic probe is currently far higher than metallic.

Figure 7:
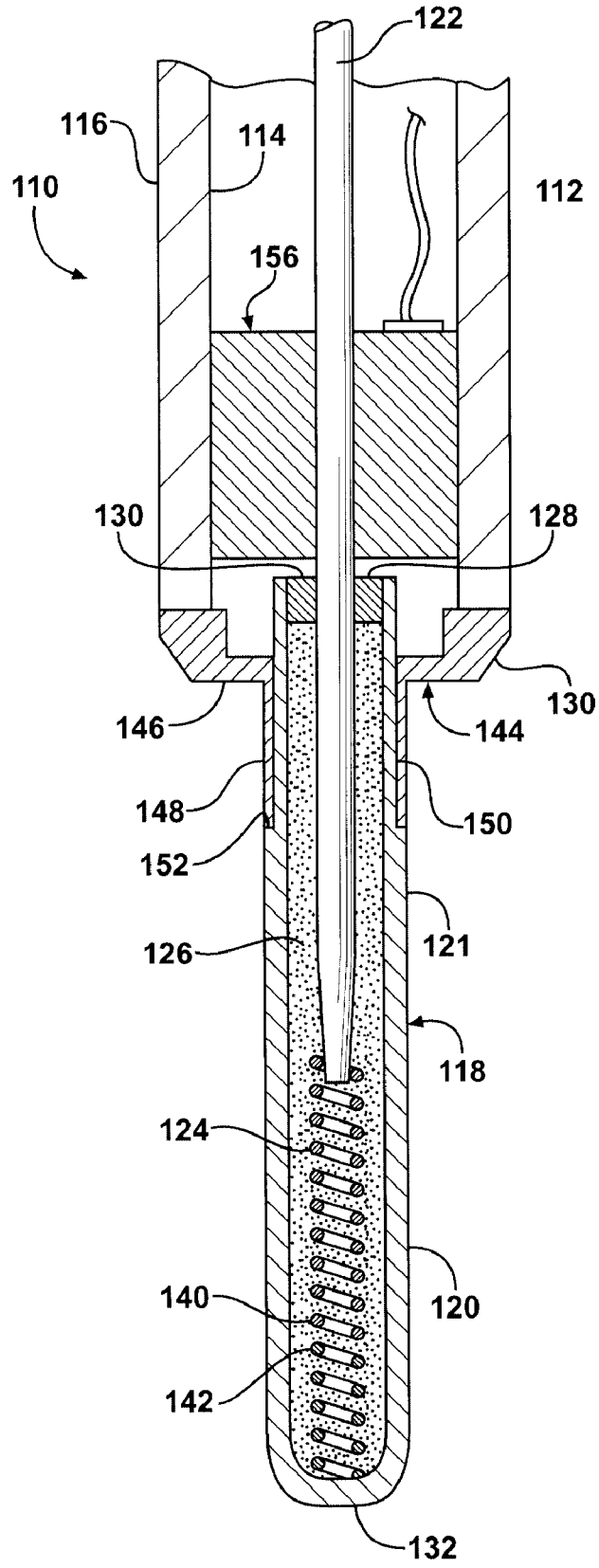
FIG. 7 is a cross-sectional view of yet another alternative embodiment wherein a pressure sensor is affixed between the electrode and the shell.

In FIG. 7, yet another alternative embodiment of this invention is depicted. In this example, a pressure sensor, generally shown at 156, is integrated into the glow plug assembly. The pressure sensor 156 is affixed between the electrode 122 and the shell 112 and adapted to monitor pressure fluctuations in a combustion chamber. In this application, the membrane 146 must be substantially thinned, so as to be elastically deformable. Thus, as pressures in a combustion chamber fluctuate, the heater probe 118 together with the electrode 122 will move up and down relative to the shell 112. The pressure sensor 156 registers these movements and transmits corresponding electrical signals to an electronic control module or other suitable monitoring device.

A particular advantage of the subject invention is that manufacture of a glow plug assembly 110 is substantially similar to prior art glow plug assembly techniques. In one forming sequence, the pilot section 150 can be introduced after the heater probe 118 is manufactured by an operation such as swaging, hammering, machining, grinding or the like. The final diameter of the pilot section 150 is chosen so as to leave enough strength in the metal sheath 120 to maintain the seal 128. The glow plug shell 112 is manufactured with the transition zone 144 to suit this reduced diameter pilot section 150. As a consequence, the shell 112 may be attached to the heater probe 118 by brazing, soldering, welding (including laser welding 154), thermal shrink-fit or even, with appropriate control of tooling and loads, an interference fit. Because the diameter of the joint section 150 may be reduced significantly from prior art designs, a normal metallic probe may be used where previously only a ceramic probe could fit. Various forms of laser welding 154 are shown as supplemental to or in lieu of other forms of joining the components. If access is possible to the inside of the glow plug shell 112, a laser welding technique like that shown in FIG. 5 may be preferred. However, if there is no access or if the pilot section 150 is very thin at this location, a laser welding technique as illustrated in FIG. 4 may be used. Additionally, one laser weld bead (in any of the three positions) may be used in conjunction with a thermal shrink-fit or a light interference. When employing a brazing-type joint, the entire mating face between pilot section 150, shoulder 152 and tube portion 148 may be bonded.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. A glow plug assembly of the type for assisting cold start combustion in a combustion chamber, said assembly comprising:

a generally tubular metal shell defining an axially extending bore;

a transition zone associated with said shell, said transition zone having a circular seat concentric with said bore and adapted to establish a seal against an opening in the combustion chamber, a generally annular membrane extending radially inwardly from said seat, and a hollow tube portion extending axially from said membrane;

an elongated heater probe axially aligned with said bore of said shell, said heater probe including a generally tubular metallic sheath extending between open first and closed second ends, said sheath having a generally cylindrical outer body surface; and said sheath including a reduced diameter pilot section at said open first end thereof, said pilot section having a reduced diameter relative to said outer body surface and separated from said outer body surface by a shoulder, said reduced diameter pilot section and said shoulder forming a joint area in direct abutting contact with said tube portion of said transition zone.

2. The assembly of claim 1, wherein said heater probe includes a resistance heating element disposed in said sheath, and an electrically insulating, thermally conductive powder surrounding said resistance heating element.

3. The assembly of claim 2, further including an electrode disposed within said bore of said shell while being electrically insulated therefrom, said electrode operatively contacting said resistance heating element of said heater probe to transfer an electrical charge thereto.

4. The assembly of claim 3, wherein said heater probe includes a probe seal operatively disposed between said open first end of said sheath and said electrode.

5. The assembly of claim 1, wherein said membrane and said seat are integrally formed as a unitary structure.

6. The assembly of claim 5, further including a pressure sensor affixed between said electrode and said shell.

7. The assembly of claim 6, wherein said membrane of said transition zone is elastically deformable.

8. The assembly of claim 5, wherein said tube portion of said transition zone has a length and a generally constant outer diameter along said length.

9. The assembly of claim 8, wherein said outer diameter of said tube portion is greater than a diameter of said outer body surface of said heater probe.

10. The assembly of claim 8, wherein said outer diameter of said tube portion is generally equal to the diameter of said outer body surface of said heater probe.

11. The assembly of claim 5, wherein said tube portion of said transition zone has a length and a variable outer diameter along said length.

12. The assembly of claim 5, wherein said tube portion of said transition zone is affixed to said pilot section of said heater probe with at least one weld.

13. The assembly of claim 5, wherein said tube portion of said transition zone is affixed to said pilot section of said heater probe with at least two axially spaced welds.

14. The assembly of claim 13, wherein one of said at least two axially spaced welds passes through said shoulder.

15. The assembly of claim 5, wherein said tube portion of said transition zone is affixed to said pilot section of said heater probe with a mechanical interference fit.

16. The assembly of claim 5, wherein said tube portion of said transition zone is affixed to said pilot section of said heater probe with a brazing or soldering bond.

17. A glow plug assembly of the type for assisting cold start combustion in a combustion chamber, said assembly comprising:

a generally tubular metal shell defining an axially extending bore;

a transition zone associated with said shell, said transition zone having a circular seat concentric with said bore and adapted to establish a seal against an opening in the combustion chamber, a generally annular membrane extending radially inwardly from said seat, and a hollow tube portion extending axially from said membrane;

an elongated heater probe axially aligned with said bore of said shell, said heater probe including a generally tubular metallic sheath extending between open first and closed second ends, said sheath having a generally cylindrical outer body surface, a resistance heating element disposed in said sheath, and an electrically insulating, thermally conductive powder surrounding said resistance heating element;

an electrode axially disposed within said bore of said shell and electrically insulated therefrom, said electrode operatively contacting said resistance heating element of said heater probe to transfer an electrical charge thereto; and said sheath including a reduced diameter pilot section at said open first end thereof, said pilot section having a reduced diameter relative to said outer body surface and separated from said outer body surface by a shoulder, said reduced diameter pilot section and said shoulder forming a joint area in direct abutting contact with said tube portion of said transition zone.

18. A glow plug assembly of the type for assisting cold start combustion in a combustion chamber, said assembly comprising:

a generally tubular metal shell defining an axially extending bore;

a transition zone associated with said shell, said transition zone having a circular seat concentric with said bore and adapted to establish a seal against an opening in the combustion chamber, a generally annular membrane extending radially inwardly from said seat, and a hollow tube portion extending axially from said membrane;

an elongated heater probe axially aligned with said bore of said shell, said heater probe including a generally tubular metallic sheath extending between open first and closed second ends, said sheath having a generally cylindrical outer body surface, a resistance heating element disposed in said sheath, and an electrically insulating, thermally conductive powder surrounding said resistance heating element;

an electrode axially disposed within said bore of said shell and electrically insulated therefrom, said electrode operatively contacting said resistance heating element of said heater probe to transfer an electrical charge thereto;

said sheath including a reduced diameter pilot section at said open first end thereof, said pilot section having a reduced diameter relative to said outer body surface and separated from said outer body surface by a shoulder, said reduced diameter pilot section and said shoulder forming a joint area in direct abutting contact with said tube portion of said transition zone; and a pressure sensor affixed between said electrode and said shell adapted to monitor pressure fluctuations in the combustion chamber.

19. The assembly of claim 18, wherein said membrane of said transition zone is elastically deformable.

* * * * *